United States Patent [19]

Swistun

[11] Patent Number: 4,727,614

[45] Date of Patent: Mar. 1, 1988

[54] GROUND CORONA COMB

[75] Inventor: Gwido K. Swistun, Saco, Me.

[73] Assignee: Shape Inc., Biddeford, Me.

[21] Appl. No.: 4,417

[22] Filed: Jan. 20, 1987

[51] Int. Cl.[4] ..... B08B 6/00; B08B 5/02

[52] U.S. Cl. ..... 15/1.5 R; 15/306 B; 15/345; 361/220

[58] Field of Search ..... 15/1.5 R, 306 R, 306 A, 15/306 B, 345; 361/212, 213, 214, 215, 220, 222

[56] References Cited

U.S. PATENT DOCUMENTS

| | | | |
|---|---|---|---|
| 3,536,528 | 10/1970 | De Geest | 361/213 X |
| 3,904,929 | 9/1975 | Kanaya et al. | 361/220 |
| 3,939,526 | 2/1976 | Mania et al. | 15/306 B |
| 4,198,061 | 4/1980 | Dunn | 15/1.5 R |
| 4,313,767 | 2/1982 | Bemis et al. | 134/1 |
| 4,454,621 | 6/1984 | Testone | 15/345 X |

FOREIGN PATENT DOCUMENTS

| | | | |
|---|---|---|---|
| 2614112 | 10/1977 | Fed. Rep. of Germany | 361/214 |

*Primary Examiner*—Chris K. Moore

*Attorney, Agent, or Firm*—Staas & Halsey

[57] ABSTRACT

A cleaning apparatus using an ionized fluid, such as air, to dislodge charged debris from a workpiece includes a ground corona comb disposed adjacent the workpiece. The ground corona comb has a jagged edge which conforms to the surface of the workpiece. The ground corona comb is attached to a vacuum device which suctions the dislodged debris from the vicinity of the workpiece. Utilization of the ground corona comb reduces the time required for the cleaning process by quickly discharging all electrical charges on the debris enabling the debris to be swiftly suctioned off by the vacuum device.

17 Claims, 6 Drawing Figures

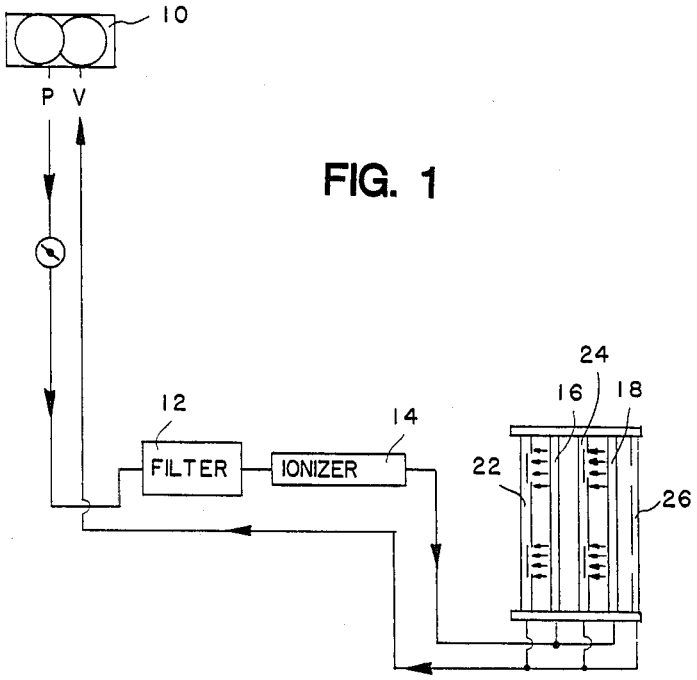
FIG. 1
FIG. 2
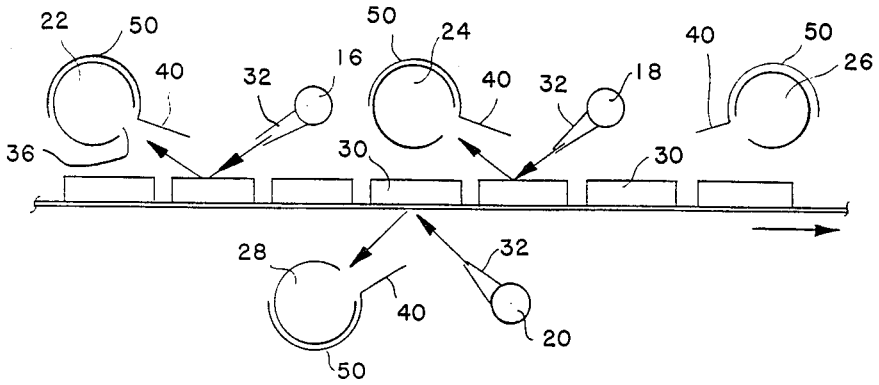

GROUND CORONA COMB

BACKGROUND OF THE INVENTION

1. Field of the Invention

The present invention is related to efficient removal of debris from a workpiece and, more particularly, to the removal of debris attracted to the workpiece by static charge in an apparatus using jets of ionized air to dislodge the debris.

2. Description of the Related Art

When articles are manufactured of metal or plastic, for example in machining and finishing steps, debris is created which often becomes attracted to the articles by static electricity. A conventional technique for removing such charged debris from a workpiece is to direct jets of ionized air at the workpiece. The force of the air dislodges the charged particles and the ions present in the air neutralize the difference in static charge between the workpiece and the debris. The dislodged debris is then withdrawn from the air surrounding the workpiece by some means, such as a suction or vacuum device. Devices using techniques like that described above are disclosed in U.S. Pat. Nos. 3,939,526 to Mania et al. and 4,313,767 to Bemis et al.

The technique described above results in the workpiece and the dislodged debris having some static charge residue of opposite polarity. The voltage potential of that residue will depend on the density of ions in the ionized air directed towards the workpiece and the grounding characteristics of the environment. The grounding characteristics are related to conductance of the air or gas in the environment and the distance between the workpiece and a well grounded conductor. As a result, the dislodged debris can be attracted to other surfaces until the charge thereon is dissipated. As a result, the cleaning process can take several minutes and typically requires batch processing, rather than continuous assembly line processing of components.

SUMMARY OF THE INVENTION

An object of the present invention is to reduce the time required for cleaning a workpiece using jets of ionized fluid or air.

Another object of the present invention is to provide an apparatus for removing charged debris from workpieces continuously conveyed through the apparatus.

The above objects are attained by providing a ground corona comb in an ionized fluid cleaning apparatus. The ionized fluid cleaning apparatus also includes a nozzle for directing a jet of ionized fluid toward a workpiece carrying debris and a suction pipe, having an opening therein, for withdrawing the debris dislodged by the jet of ionized fluid. The ground corona comb comprises a plate, formed of electrically conductive material, having a jagged edge disposed adjacent to and separated from the workpiece and grounding means for electrically grounding the plate.

Preferably, the plate is disposed downstream of the nozzle supplying the jet of ionized fluid and is attached to the suction pipe adjacent the opening therein. The jet of ionized fluid is deflected by the workpiece into a deflected stream and the plate is disposed in a position which channels the deflected stream toward the opening in the suction pipe.

In a preferred embodiment of the present invention, a plurality of nozzles, providing jets of ionized fluid, have tips aligned along a line and the plate is positioned substantially parallel to the line of the tips of the plurality of nozzles. This embodiment can be used to clear workpieces conveyed through the ionized fluid cleaning apparatus in a conveyance direction from an entrance to an exit. In such an application, the jets of ionized fluid are directed along vectors, each having a first component toward the workpiece and a second component opposite to the conveyance direction. The jets of ionized fluid are deflected by a deflection surface of the workpiece. The plate is disposed at a first distance from the entrance and the deflection surface is located a second distance, greater than the first distance, from the entrance.

Another embodiment of the present invention can be used to clean a workpiece rotated around a rotation axis within the ionized fluid cleaning apparatus. Vacuum means is disposed symmetrically around the rotation axis of the workpiece and a ground corona comb comprises a band of metal having a jagged inner edge and an outer edge attached to the vacuum means. This embodiment can be used to clean a disk-shaped workpiece in which case the vacuum means preferably comprises a vacuum source for providing suction and a fluid conduit, coupled to the vacuum source, having a thick pancake shape with top and bottom surfaces and a central opening symmetrically formed around the rotation axis. The workpiece is substantially aligned during cleaning with the bottom surface of the fluid conduit and the outer edge of the ground corona comb is attached to the top surface of the fluid conduit. Pressurized means is also included in this embodiment and preferably comprises a pair of pipes, disposed above the top surface of the fluid conduit, having parallel central axes defining a plane substantially perpendicular to the rotation axis. The central axes of the pair of pipes are disposed substantially equidistant from the rotational axis at a distance smaller than the radius of the disk-shaped workpiece. Nozzles are coupled to the pair of pipes substantially perpendicular to the central axes of said pair of pipes, for directing the jets of ionized fluid non-perpendicularly toward the workpiece.

These objects, together with other objects and advantages which will be subsequently apparent, reside in the details of construction and operation as more fully hereinafter described and claimed, reference being had to the accompanying drawings forming a part hereof, wherein like reference numerals refer to like parts throughout.

BRIEF DESCRIPTION OF THE DRAWINGS

FIG. 1 is a block diagram of an ionized fluid cleaning apparatus for cleaning manufactured articles on an assembly line in which the present invention can be used;

FIG. 2 is a side view of articles being cleaned by an ionized fluid cleaning apparatus incorporating the present invention;

DESCRIPTION OF THE PREFERRED EMBODIMENTS

Figure 3:
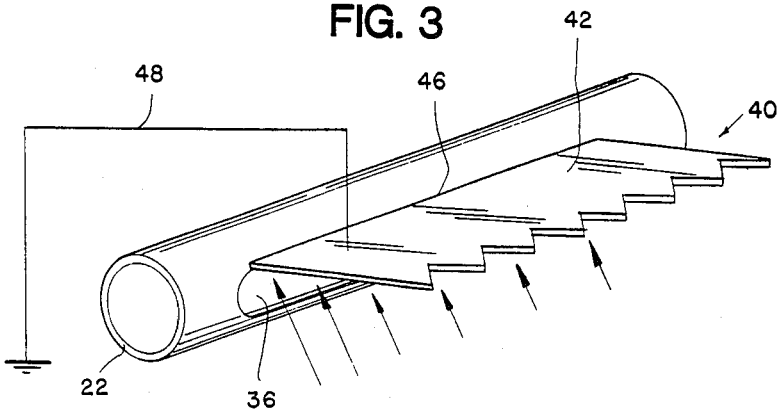
FIG. 3 is a perspective view of a ground corona comb attached to a vacuum pipe.

As noted above, one of the determinants of grounding characteristics of an environment is the distance between the workpiece and a good electrical ground. The present invention is able to achieve the above objects by improving the grounding capacity of the environment around the workpiece. According to the present invention, a ground corona comb is placed close to the workpiece with jagged edges directed towards the incoming debris to produce a dense electric field of opposite polarity resulting in complete and fast discharge of residual static charge.

An ionized fluid cleaning apparatus according to the present invention uses a blower 10 of sufficient power to provide pressurized air P and a vacuum source V. The pressurized air supplied by the blower 10 is filtered and ionized in a filter 12 and ionizer 14. The filter and ionizer may be formed in a single unit, or may be separate units. For example, a combined unit may comprise an 18 inch length of four inch diameter pipe containing a ten inch long ionizing bar 80300-5000H available from Chapman Co., and a filter comprising two wire mesh screens sandwiching #1W755 polyurethane and #1W633 fiberglass from W.W. Granger, Inc., both of Portland, Me. The filtered, ionized and pressurized air is supplied to first and second pressure manifolds 16 and 18 above the assembly line and a third pressure manifold 20 (FIG. 2) below the conveyor. First, second and third vacuum means or suction pipes 22, 24 and 26 above the conveyor and fourth vacuum means 28 below the conveyor suction the air from the immediate vicinity of the conveyor and are coupled to the vacuum source V provided by blower 10.

Manufactured articles or workpieces 30, such as injection molded video cassette shells, carrying debris, are conveyed along the assembly line by conveyance means (not shown), such as an open webbing, series of rollers, etc., which engage the workpieces 30. Each of the pressurized means 16, 18 and 20 include nozzles 32 which direct jets of the ionized air toward a surface of a workpiece 30. For example, first pressurized means 16 directs jets of ionized air toward a deflection surface 34 which deflects the jets of ionized air into a deflected stream in the direction of an opening 36 in first vacuum means 22.

According to the present invention, a ground corona comb 40 is attached to each of the vacuum means. As illustrated in FIG. 3, the ground corona comb 40 comprises a plate 42 having a first, jagged edge 44 and a second edge 46 attached to the vacuum means or suction pipe 22 near an opening or slot 36 in the pipe 22. The ground corona comb 40 may be connected to electrical ground via a separate line shown schematically as line 48 in FIG. 3, or if the suction pipe 22 is formed of conductive material, the suction pipe 22 may be grounded at a location remote from the ground corona comb 40. In this case, the ground corona comb 40 must be electrically connected as well as physically connected to the suction pipe 22.

For example, the ground corona comb 40 and suction pipe 22 may be formed of metallic copper which is widely available in pipe form and an excellent conductor of electricity. The plate 42 may be attached to the suction pipe 22 by soldering, or may be simply clipped on via a hemicylindrical attachment means 50 (FIG. 2).

In the embodiment illustrated in FIGS. 1 and 2, the pressure and suction pipes 16–28 are arranged perpendicular to the conveyance direction of the workpieces 30. The pressure pipes 16, 18 and 20 direct the jets of ionized air along vectors, such as vector 52 having a component 54 in a first direction toward the workpiece and a second component 56 in a second direction opposite to the conveyance direction. Therefore, the vacuum means corresponding to each pressurized means, e.g., vacuum means 28 corresponding to pressurized means 20, is positioned closer to the entrance through which the workpieces 30 pass than the pressurized means. In the embodiment illustrated in FIG. 2, one set of pressurized and vacuum means are provided below the workpieces 30 and two sets are provided above the workpiece. In addition, the third vacuum means 26 is positioned near the exit of the workpieces 30 to suction off any remaining dislodged debris. As most clearly illustrated in FIG. 1, the pressure pipes 16 and 18 and suction pipes 22, 24 and 26 are positioned parallel to each other and perpendicular to the conveyance direction. One result of the above-described structure is that the movement of the workpieces 30 provides additional force for dislodging charged debris clinging thereto.

Figure 4:
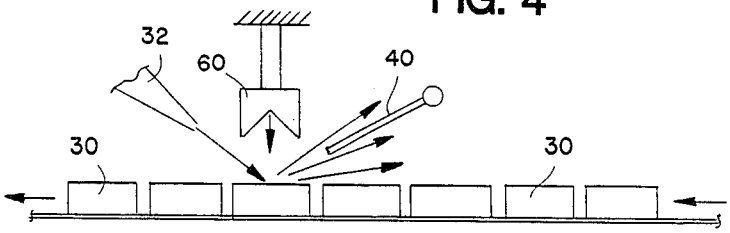
FIG. 4 is a side view of a de-staticizing line utilizing the present invention.

A second embodiment is illustrated in FIG. 4 in which the ground corona comb 40 is used in a de-staticizing line. As in FIG. 2, a nozzle 32 directs an air jet along a vector having a component in a direction opposite to the conveyance direction, in this case right to left, of the workpieces 30. An ionizing bar 60 performs de-staticizing by generating a corona using, for example, 5000 volts.

Figure 5A:
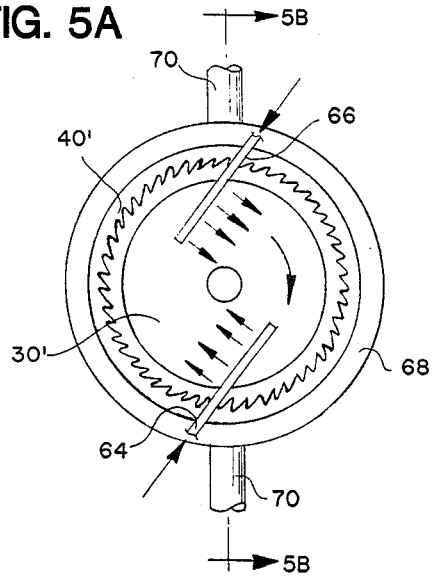
FIGS. 5A and 5B are top and side views, respectively, of an ionized fluid cleaning apparatus, incorporating the present invention, for cleaning a rotating disk-shaped workpiece.
Figure 5B:
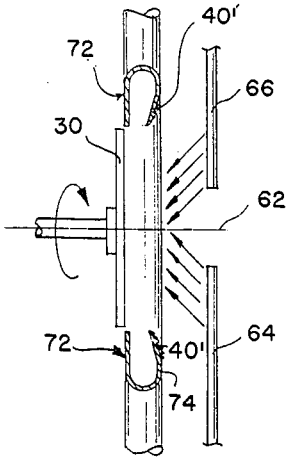

A third embodiment of the present invention is illustrated in FIGS. 5A and 5B. This embodiment may be used for cleaning, e.g., a disk-shaped workpiece 30' which is rotated around a rotation axis 62. The disk-shaped workpiece 30' may, for example, be produced by injection molding during the manufacturing of a compact disk with the present invention used prior to a sputtering step. The pressurized means 64 and 66 are similar to those used in the embodiment illustrated in FIGS. 1 and 2 and have parallel central axes defining a plane substantially perpendicular to the rotation axis, as best illustrated in FIG. 5B. The central axes of pressurized means 64 and 66 are, as illustrated in FIG. 5A, substantially equidistant from the rotational axis at a distance smaller than the radius of the disk-shaped workpiece 30', so that nozzles (not shown) are disposed directly above a surface of the workpiece 30'. Jets of ionized air can thus be directed perpendicular to the central axes of the pipes 64 and 66 and deflected by the deflection surface of the workpiece 30'.

In the embodiment illustrated in FIGS. 5A and 5B, vacuum means is provided by a fluid conduit 68 coupled to the vacuum source V of the blower 10 via pipes 70. The fluid conduit 68 has a thick pancake shape with a central opening having a radius approximately the same size or slightly greater than the radius of the disk 30'. During cleaning, the disk 30' is aligned near the bottom surface 72 of the fluid conduit 68. A ground corona comb 40' is formed as a metal band having a first jagged edge disposed above the deflection surface of the disk 30', and a second edge attached to a top surface 74 of the fluid conduit 68.

Charged debris is dislodged from the deflection surface of the disk 30' by the jets of ionized air directed at a nonperpendicular angle downward onto the deflection surface of the disk 30'. A partial vacuum is generated within the fluid conduit 68 to suction the dislodged debris away from the deflection surface of the disk 30'. The ground corona comb 74 neutralizes all charge on the dislodged debris so that there are no static electricity forces to counteract the force of the partial vacuum.

The many features and advantages of the present invention are apparent from the detailed specification and thus, it is intended by the appended claims to cover all such features and advantages of the device which fall within the true spirit and scope of the invention. Further, since numerous modifications and changes will readily occur to those skilled in the art, it is not desired to limit the invention to the exact construction and operation illustrated and described. Accordingly, all suitable modifications and equivalents may be resorted to falling with the scope and spirit of the invention. For example, the described and illustrated embodiments all utilize ionized air, but other fluids such as water or organic cleaning compounds may be used, as known in the art.

What is claimed is:

1. A ground corona comb in an ionized fluid cleaning apparatus, the ionized fluid cleaning apparatus including a nozzle for directing a jet of ionized fluid toward a workpiece carrying debris, and a suction pipe having an opening therein for withdrawing the debris dislodged by the jet of ionized fluid, said ground corona comb comprising:

a plate, formed of electrically conductive material, having a jagged edge disposed adjacent to and separated from the workpiece; and grounding means for electrically grounding said plate.

2. A ground corona comb as recited in claim 1, wherein said plate is disposed downstream of the nozzle supplying the jet of ionized fluid.

3. A ground corona comb as recited in claim 2, further comprising attachment means for attaching said plate to the suction pipe adjacent the opening therein.

4. A ground corona comb as recited in claim 3, wherein the jet of ionized fluid is deflected by the workpiece into a deflected stream, and wherein said plate is disposed in a position channeling the deflected stream toward the opening in said suction pipe.

5. A ground corona comb as recited in claim 4, wherein the ionized fluid cleaning apparatus further comprises additional nozzles, providing jets of ionized fluid, having tips aligned along a line, and wherein said plate is substantially parallel to the line of the tips of the additional nozzles.

6. A ground corona comb as recited in claim 4, wherein the workpiece has a deflection surface deflecting the jet of ionized fluid, and wherein the jagged edge of said plate conforms to the deflection surface of the workpiece.

7. An ionized fluid cleaning apparatus for removing debris from a workpiece, comprising:

pressurized means for directing jets of ionized fluid at the workpiece to dislodge the debris;

vacuum means for suctioning the debris dislodged by the jets of ionized fluid; and a ground corona comb, formed from electrically conductive material and operatively connected to electrical ground, having a jagged edge disposed adjacent to and separate from the workpiece.

8. An ionized fluid cleaning apparatus as recited in claim 7, wherein said ground corona comb comprises:

a plate having a first edge providing the jagged edge and a second edge opposite the first edge; and grounding means for electrically grounding said plate.

9. An ionized fluid cleaning apparatus as recited in claim 8, wherein said pressurized means directs the jets of ionized fluid along a first plane until deflected by a deflection surface of the workpiece, and wherein said plate is disposed in a second plane intersecting the first plane along an intersection line located upstream from the deflection surface.

10. An ionized fluid cleaning apparatus as recited in claim 9, wherein the intersection line is substantially parallel to the workpiece.

11. An ionized fluid cleaning apparatus as recited in claim 9, wherein the workpiece is conveyed through said ionized fluid cleaning apparatus in a conveyance direction from an entrance to an exit, wherein the jets of ionized fluid are directed along vectors, each having a first component in a first direction toward the workpiece and a second component in a second direction opposite to the conveyance direction, and wherein said plate is disposed at a first distance from the entrance and the deflection surface is located at a second distance, greater than the first distance, from the entrance.

12. An ionized fluid cleaning apparatus as recited in claim 9, wherein the jagged edge of said plate conforms to the deflection surface of the workpiece.

13. An ionized fluid cleaning apparatus as recited in claim 7, wherein the workpiece is rotated around a rotation axis within said ionized fluid cleaning apparatus, wherein said vacuum means is disposed symmetrically around the rotation axis of the workpiece, and wherein said ground corona comb comprises a band of metal having a jagged inner edge and an outer edge attached to said vacuum means.

14. An ionized fluid cleaning apparatus as recited in claim 13, wherein the workpiece is disk-shaped, wherein said vacuum means comprises:

a vacuum source for providing suction; and a fluid conduit, coupled to said vacuum source, having a thick pancake shape with top and bottom surfaces and a central opening symmetrically formed around the rotation axis, the workpiece being substantially aligned during cleaning with the bottom surface of said fluid conduit, the outer edge of said ground corona comb being attached to the top surface of said fluid conduit, and wherein said pressurized means comprises:

a pair of pipes, disposed above the top surface of said fluid conduit, having parallel central axes defining a plane substantially perpendicular to the rotation axis, the central axes of said pair of pipes disposed substantially equidistant from the rotational axis at a distance smaller than the radius of the disk-shaped workpiece; and nozzles, coupled to said pair of pipes substantially perpendicular to the central axes of said pair of pipes, for directing the jets of ionized fluid nonperpendicularly toward the workpiece.

15. An ionized fluid cleaning apparatus for removing debris from workpieces, having upper and lower surfaces, said apparatus comprising:

conveyance means for conveying the workpieces through said ionized fluid cleaning apparatus in a conveyance direction from an entrance to an exit;

first and second pressurized means disposed above the conveyance means for directing jets of ionized fluid along substantially parallel first and second planes toward the workpieces to dislodge the debris from the upper surface of the workpieces, said second pressurized means following said first pressurized means in the conveyance direction;

first, second and third vacuum means, disposed above said conveyance means, said first vacuum means preceding said first pressurized means in the conveyance direction, said second vacuum means disposed between said first and second pressurized means and said third vacuum means following said second pressurized means in the conveyance direction;

third pressurized means disposed below said conveyance means, for dislodging debris from the lower surface of the workpieces;

fourth vacuum means, disposed below said conveyance means and preceding said third pressurized means in the conveyance direction, for suctioning the debris dislodged by the jets of ionized fluid issuing from said third pressurized means; and ground corona combs, attached to said first through fourth vacuum means, formed from electrically conductive material and operatively connected to electrical ground, having a jagged edge disposed adjacent to and separated from the workpieces.

16. An ionized fluid cleaning apparatus as recited in claim 15, wherein said first through third pressure means and said first through fourth vacuum means all comprise pipes substantially parallel to each other and perpendicular to the conveyance direction.

17. A ground corona comb in an ionized fluid cleaning apparatus, the ionized fluid cleaning apparatus including a nozzle for directing a jet of ionized fluid toward a workpiece carrying charged debris, and a suction pipe having an opening therein for withdrawing the charged debris dislodged by the jet of ionized fluid, said ground corona comb comprising:

a plate, formed of electrically conductive material, having a jagged edge disposed adjacent to and separated from the workpiece; and grounding means for electrically grounding said plate to accelerate electrical discharge of the ionized fluid and for forming a dense electrical field around the jagged edges of said plate, the dense electrical field having a polarity opposite to that of the charged debris dislodged by the jet of ionized fluid.

* * * * *